US005239754A

United States Patent [19]

Watson et al.

[11] Patent Number: 5,239,754

[45] Date of Patent: Aug. 31, 1993

[54] POWER TAKE-OFF SYSTEM FOR CHAIN SAW

[75] Inventors: William L. Watson, Rte. 1, Mitchell, Nebr. 69357; Kenneth E. Watson, Morrill, Nebr.

[73] Assignee: William L. Watson, Mitchell, Nebr.

[21] Appl. No.: 699,209

[22] Filed: May 13, 1991

[51] Int. Cl.[5] ..... B27B 17/02

[52] U.S. Cl. ..... 30/122; 30/384; 144/1 F

[58] Field of Search ..... 30/384, 383, 122; 144/1 R, 35 R, 208 C, 208 H, 208 J, 1 F, 1 E; 83/574

[56] References Cited

U.S. PATENT DOCUMENTS

| | | | |
|---|---|---|---|
| 2,708,468 | 5/1955 | Lantz | 144/208 H |
| 4,063,358 | 12/1977 | Hodge | 30/371 |
| 4,321,838 | 3/1982 | Feldman | 30/122 X |
| 4,506,444 | 3/1985 | Sundström | 30/384 X |
| 4,985,997 | 1/1991 | Gross, Sr. | 30/122 |

FOREIGN PATENT DOCUMENTS

| | | | |
|---|---|---|---|
| 2168646 | 6/1986 | United Kingdom | 30/383 |

*Primary Examiner*—Frank T. Yost
*Assistant Examiner*—Raymond D. Woods
*Attorney, Agent, or Firm*—Dean P. Edmundson

[57] ABSTRACT

A power take-off system for attachment to the elongated bar of a chain saw. A shaft is rotatably carried by a housing which is attached to the bar of the chain saw. A gear is carried on the shaft and is located in a transverse aperture in the bar such that the gear is driven by the nose sprocket in the bar. The housing serves as a guard over the chain on the bar also. The power take-off system may be provided as a self-contained integral unit which replaces the existing cutting bar on the chain saw.

11 Claims, 2 Drawing Sheets

POWER TAKE-OFF SYSTEM FOR CHAIN SAW

FIELD OF THE INVENTION

This invention relates to power take-off systems. More particularly, this invention relates to systems for powering a drive shaft. Even more particularly, this invention relates to systems for using a chain saw for powering auxiliary equipment.

BACKGROUND OF THE INVENTION

A conventional chain saw includes a gasoline-powered internal combustion engine. It has been used to power winches, hedge trimmers, lawn edgers, etc. In order to serve such purposes, it has been necessary to first remove or detach the saw bar and chain. Then the chain saw engine can be operably connected to the device which is to be powered by the engine. In order to use the chain saw for its normal intended purpose again, it is necessary to uncouple the engine from the device it has been powering, after which the bar and chain must be installed again. This is inconvenient and cumbersome. It may also require sue of special brackets or mounting hardware in order to connect the chain saw engine to the device to be powered.

SUMMARY OF THE PRESENT INVENTION

In accordance with the present invention there is provided a power take-off system for attachment to a chain saw, wherein the elongated bar includes a rotatable nose sprocket driven by an endless chain, and wherein the bar includes a transverse aperture. The power take-off system further comprises:

(a) at least one housing member;

(b) a power take-off shaft rotatably carried by the housing member;

(c) a gear member carried on the shaft; and (d) attachment means for attaching the housing member to the bar in a manner such that the gear member is disposed in the aperture in driving engagement with the nose sprocket in the bar.

The power take-off system of the invention enables a conventional chain saw engine to be used to drive a variety of auxiliary devices without disassembly of the chain saw itself. The power take-off system, including an elongated bar with transverse aperture, can be readily and easily attached to the chain saw engine, and it can be quickly and simply detached when it is no longer needed.

The present invention also provides an embodiment of a power take-off system which is an integral, self-contained unit for attachment to a conventional chain saw engine after detaching the existing cutting bar.

Other advantages of the power take-off system of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
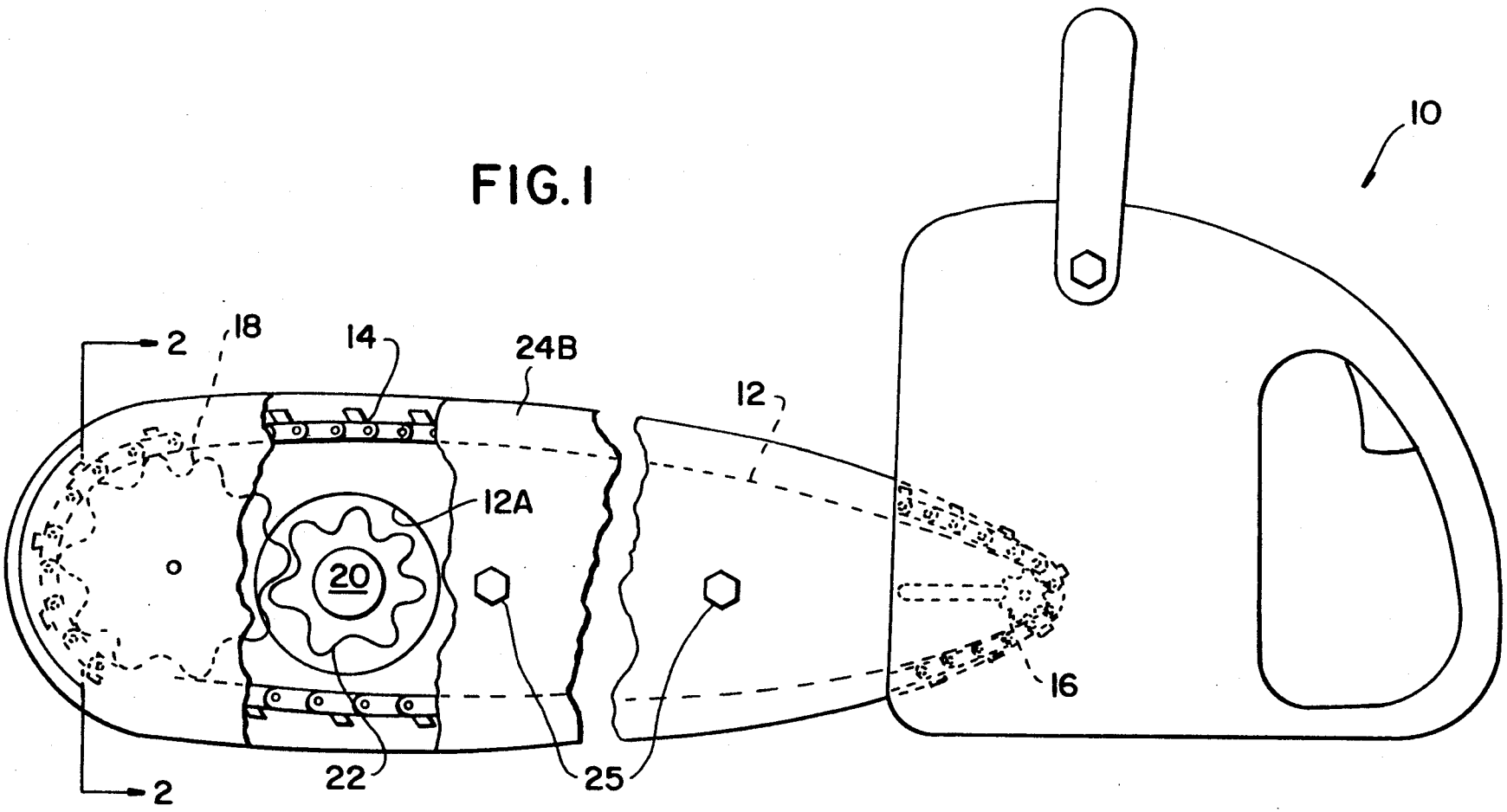
FIG. 1 is a side elevational view (partially cut-away) showing the power take-off system of the invention attached to a conventional chain saw.
Figure 2:
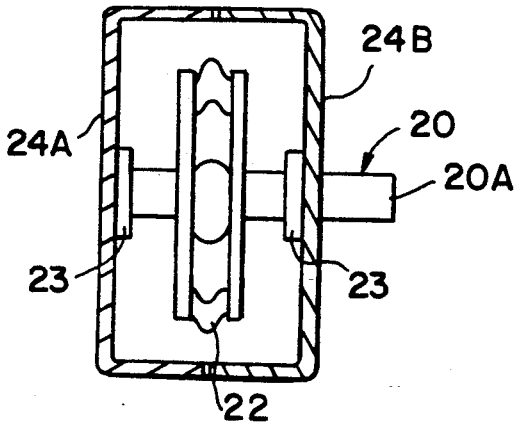
FIG. 2 is a cross-sectional view along line 2—2 in FIG. 1.
Figure 3:
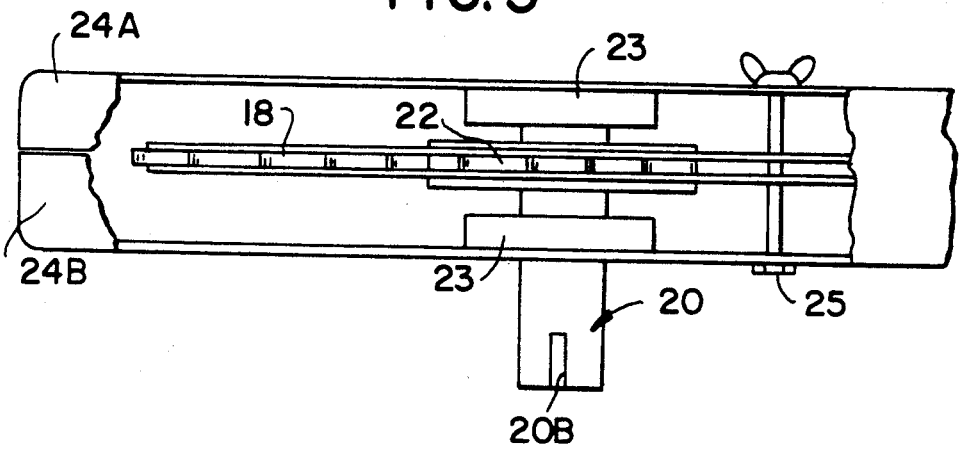
FIG. 3 is a partial cut-away, top view of the chain saw bar with the power take-off attachment connected to the bar.

In FIGS. 1–3 there is illustrated one embodiment of a power take-off system for attachment to the elongated bar 12 of a conventional chain saw 10. An endless chain 14 travels the periphery of the bar 12 and is driven by drive gear 16 operably connected to the engine of the chain saw.

A rotatable sprocket 18 is carried at the outer end of the bar and is caused to rotate by the driven chain 14. A transverse opening 12A extends through the bar in a manner such that the teeth of sprocket 18 extend partially into the opening. A power take-off shaft 20, having toothed gear 22 secured thereto, is positioned through the opening 12A in the bar 12 in a manner such that the gear 22 meshes with the sprocket 18 in such opening. One end 20A of the shaft projects outwardly from the bar 12 in a manner such that it is accessible for use in driving auxiliary equipment. The gear 22 may vary in size, e.g., from about 1 inch to about 3 inches. Bearings 23 support the shaft 20 in a manner such that the shaft can rotate.

The bearings 23 are supported by housing members or guard members 24A and 24B which are disposed on opposite sides of bar 12, as illustrated. Each housing member has a height and length greater than that of the bar so that the housing members serve as guards to prevent incidental contact with the moving chain on the bar. Bolts 25 extend through the housing members and the bar 12 to secure the housing members to the bar. The shape of the housing members may vary.

Although two opposing, parallel housing members are shown in the drawings, it is possible to use a single housing member, if desired. For example, one housing member may be secured to the bar with bolts and may include flanges which extend over the bar 12 to serve as a guard over the chain.

The housing members may be composed of any suitable material. For example, they may be made of metal, or plastic, or a composite material. The housing members could be made to telescope, if desired.

The shaft 20 preferably includes a key slot 20B to facilitate securing a gear or pulley to the shaft. It is also possible to use a shaft which is splined to facilitate attachment of a gear or pulley to it. If desired, a hollow shaft having a non-circular cavity or opening therein may be used. For example, the opening in the shaft may be splined, or it may include a key slot.

The distance which the shaft 20 projects outwardly beyond housing member 24B may vary. Generally speaking, the shaft should project outwardly a distance in the range of about 0.5 to 2 inches.

The diameter of the shaft 20 may also vary. Generally speaking, the diameter of the shaft will be in the range of about 0.3 to 1 inch.

If desired, it is possible for both ends of shaft 20 to project outwardly beyond the housing (with one end projecting out from each side of the bar 12). If the shaft is to project outwardly from only one side of the housing, the shaft can project from either side, as desired.

The power take-off shaft can be used to drive various types of auxiliary devices. For example, it can be used to drive a water pump, air compressor, electric generator, ice auger, winch, hydraulic pump, speed reducers, hose reels, etc. No modification of the chain saw engine is required in order to attach the power take-off system of this invention. An appropriate transverse aperture must either be provided in an existing chain saw bar, or a separate bar is used which has been manufactured with the required aperture. The bolts 25 hold the power take-off system in place and do not cause any damage to the bar.

When the power take-off system is no longer needed it may be easily and quickly detached from the bar by simply removing bolts 25. Then the chain saw can be used for its normal purpose. Alternatively, the bar (with attached power take-off system) can be detached from the chain saw engine and replaced with a conventional cutting bar and chain.

Figure 4:
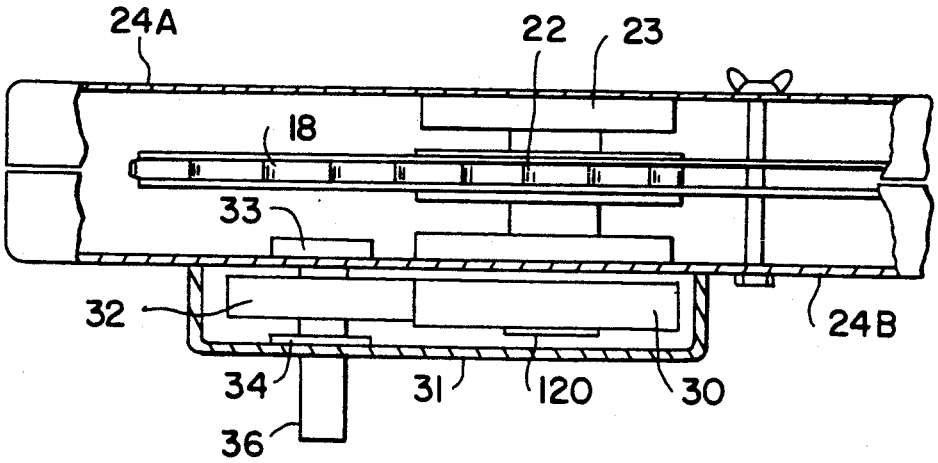
FIG. 4 is a partial cut-away, top view of another embodiment of power take-off attachment of the invention connected to a chain saw bar.

FIG. 4 illustrates another version of the power take-off system of the invention. In this embodiment shaft 120 is driven by gear 22. A gear 30 is secured to the outer end of shaft 120 and is driven by the shaft. Power take-off shaft 36 is support by bearings 33 and 34. Gear 32 is secured to shaft 36 and is driven by gear 30. A guard or enclosure 31 encloses gears 30 and 32. The arrangement shown here effects a change in the speed of the shaft 36 relative to the speed of shaft 120.

In another variation, the normal cutting chain on the chain saw can be replaced with a conventional chain (not including cutting elements). In yet another variation, the power take-off system may be provided as an integral unit (including bar, guard and chain) which can be attached to a conventional chain saw engine after detaching the existing bar and cutting chain. In still another variation, the guard may include a gear box secured thereto for changing the speed of the output shaft relative to the speed of the gear driven by the sprocket on the bar.

Other variants are also possible without departing from the scope of this invention. For example, the power take-off system may include a pump or other desired accessory as an integral part of the system.

What is claimed is:

1. A power take-off system for attachment to an elongated bar of a chain saw, wherein said bar includes a rotatable nose sprocket driven by an endless chain; and wherein said bar includes a transverse aperture therethrough; and wherein said nose sprocket extends into said aperture, wherein said system comprises:

(a) at least one elongated housing member;

(b) a power take-off shaft rotatably carried by said housing member;

(c) a gear member carried on said shaft; and (d) attachment means for attaching said housing member to said bar in a manner such that said gear member is disposed in said aperture adjacent to and in driving engagement with said nose sprocket; and wherein said shaft is disposed perpendicularly to a longitudinal centerline of said housing member.

2. A power take-off system in accordance with claim 1, wherein there are two said housing members.

3. A power take-off system in accordance with claim 2, wherein each said housing member is planar, and wherein said housing members are of generally equal size.

4. A power take-off system in accordance with claim 2, wherein each said housing member includes a bearing to support said shaft.

5. A power take-off system in accordance with claim 2, wherein said attachment means comprises a bolt extending transversely through each said housing member in a manner such that said housing members are secured to opposite sides of said bar.

6. An improved chain saw including a power take-off system, wherein said saw includes an elongated bar having a rotatable nose sprocket driven by an endless chain, and wherein said bar includes a transverse aperture therethrough adjacent said nose sprocket; wherein said power take-off system comprises:

(a) at least one elongated housing member;

(b) a power take-off shaft rotatably carried by said housing member;

(c) a gear member carried on said shaft; and (d) attachment means for attaching said housing member to said bar in a manner such that said gear member is disposed in said aperture adjacent to and in driving engagement with said nose sprocket; and wherein said shaft is disposed perpendicularly to a longitudinal centerline of said housing member.

7. An improved chain saw in accordance with claim 6, wherein there are two said housing members.

8. An improved chain saw in accordance with claim 7, wherein each said housing member has a length greater than the length of said bar, and wherein each said housing member has a height greater than the height of said bar.

9. An improved chain saw in accordance with claim 8, wherein each said housing member is planar, and wherein said housing members are of generally equal size.

10. An improved chain saw in accordance with claim 8, wherein each said housing member includes a bearing to support said shaft.

11. An improved chain saw in accordance with claim 10, wherein said attachment means comprises a bolt extending transversely through each said housing member in a manner such that said housing members are secured to opposite sides of said bar.

* * * * *